US009837019B2

(12) United States Patent
Nagayama et al.

(10) Patent No.: US 9,837,019 B2
(45) Date of Patent: Dec. 5, 2017

(54) PIXEL CIRCUIT, ORGANIC ELECTROLUMINESCENT DISPLAY PANEL AND DISPLAY DEVICE

(71) Applicant: BOE Technology Group Co., Ltd., Beijing (CN)

(72) Inventors: Kazuyoshi Nagayama, Beijing (CN); Song Song, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 54 days.

(21) Appl. No.: 14/897,350

(22) PCT Filed: May 14, 2015

(86) PCT No.: PCT/CN2015/078928

§ 371 (c)(1),
(2) Date: Dec. 10, 2015

(87) PCT Pub. No.: WO2016/101504

PCT Pub. Date: Jun. 30, 2016

(65) Prior Publication Data

US 2016/0372030 A1 Dec. 22, 2016

(30) Foreign Application Priority Data

Dec. 24, 2014 (CN) ..... 2014 1 0818108

(51) Int. Cl.
*G09G 3/30* (2006.01)
*G09G 3/3225* (2016.01)
*G09G 3/32* (2016.01)

(52) U.S. Cl.
CPC ..... *G09G 3/3225* (2013.01); *G09G 3/32* (2013.01); *G09G 2310/0248* (2013.01);
(Continued)

(58) Field of Classification Search
CPC ..... G09G 3/32; G09G 3/3225; G09G 2320/0233; G09G 2320/0204; G09G 2310/061; G09G 2310/0248; G09G 3/30
See application file for complete search history.

(56) References Cited

U.S. PATENT DOCUMENTS

2005/0200575 A1 9/2005 Kim et al.
2005/0285825 A1 12/2005 Eom et al.
(Continued)

FOREIGN PATENT DOCUMENTS

CN 1909046 A 2/2007
CN 1912978 A 2/2007
(Continued)

OTHER PUBLICATIONS

Dated Jan. 5, 2017—(CN) Second Office Action Appn 201410818108.1 with English Tran.
(Continued)

*Primary Examiner* — Christopher E Leiby
(74) *Attorney, Agent, or Firm* — Banner & Witcoff, Ltd.

(57) ABSTRACT

A pixel circuit, an organic electroluminescent display panel and a display device, in a reset and compensation phase, a charge control module of the pixel circuit makes a data signal end and the first input end of a reset control module switch on, and the reset control module resets the control end and a output end of a drive module and compensates reference voltage; in a data writing phase, the charge control module writes the data signal inputted by the data signal end to the first input end of the reset control module; in a light-emitting phase, a light-emitting control module makes the output end of the drive module and the input end of the light emitting device switch on and drives the light emitting device to emit light by integrating the data signal inputted into the drive module with the reference voltage signal compensated into the drive module, which realizes the effect
(Continued)

that the drive current driving the light emitting device to emit light is irrelevant to the power supply voltage signal, eliminates the influence on luminous brightness of the light emitting device caused by IR drop of the power supply voltage signal inputted into the pixel circuits, and further guaranteeing the display effect of the display panel.

19 Claims, 5 Drawing Sheets

(52) U.S. Cl.
CPC ..... *G09G 2310/061* (2013.01); *G09G 2320/0204* (2013.01); *G09G 2320/0233* (2013.01)

(56) References Cited

U.S. PATENT DOCUMENTS

| | | | | |
|---|---|---|---|---|
| 2008/0158110 | A1 | 7/2008 | Iida et al. | |
| 2008/0224621 | A1 | 9/2008 | Uchino et al. | |
| 2011/0096059 | A1 | 4/2011 | Ohhashi | |
| 2011/0193856 | A1* | 8/2011 | Han ..... | G09G 3/3233 345/214 |

FOREIGN PATENT DOCUMENTS

| | | | |
|---|---|---|---|
| CN | 101399005 | A | 4/2009 |
| CN | 101697269 | A | 4/2010 |
| CN | 101800026 | A | 8/2010 |
| CN | 101996579 | A | 3/2011 |
| CN | 102339586 | A | 2/2012 |
| CN | 102436793 | A | 5/2012 |
| CN | 102682704 | A | 9/2012 |
| CN | 102842283 | A | 12/2012 |
| CN | 103077680 | A | 5/2013 |
| CN | 103137062 | A | 6/2013 |
| JP | 2005157308 | A | 6/2005 |
| JP | 2010224390 | A | 10/2010 |

OTHER PUBLICATIONS

Dated Sep. 24, 2015—(WO)—International Search Report and Written Opinion Appn PCT/CN2015/078928 with English Tran.
Dated Apr. 26, 2016—(CN)—First Office Action Appn 201410818108.1 with English Tran.

* cited by examiner

PIXEL CIRCUIT, ORGANIC ELECTROLUMINESCENT DISPLAY PANEL AND DISPLAY DEVICE

The application is a U.S. National Phase Entry of International Application No. PCT/CN2015/078928 filed on May 14, 2015, designating the United States of America and claiming priority to Chinese Patent Application No. 201410818108.1 filed on Dec. 24, 2014. The present application claims priority to and the benefit of the above-identified applications and the above-identified applications are incorporated by reference herein in their entirety.

TECHNICAL FIELD

The present disclosure relates to the display technical field, and in particular to a pixel circuit, an organic electroluminescent display panel and a display device.

BACKGROUND

As the development of display technology, the OLED (Organic Light Emitting Diode) has become one of the hot topics in the flat-panel display researching area. More and more Active Matrix Light emitting device (AMOLED) display panel have entered into the market. Compared with the traditional Thin Film Transistor Liquid Crystal Display (TFTLCD), the AMOLED has a faster response, higher contrast and a wider perspective.

Therefore, how to improve the impact of IR drop of the power supply voltage signal inputted in the pixel circuits on luminous brightness of the light emitting device OLED is an urgent problem to be solved for those skilled in the art.

SUMMARY

The embodiments of the present disclosure provide a pixel circuit, an organic electroluminescent display panel and a display device, which are used to solve the problem of IR drop of the power supply voltage signal inputted in the pixel circuits affecting luminous brightness of the light emitting device in prior art.

The embodiment of the present disclosure provides a pixel circuit, which comprises: a charge control module, a drive module, a reset control module, a light-emitting control module and a light emitting device, wherein the control end of the charge control module is connected with the scanning signal end, the input end thereof is connected with the data signal end, and the output end thereof is connected with the first input end of the reset control module;

the control end of the reset control module is connected with the threshold voltage signal end, the second input end thereof is connected with the reference signal end and the input end of the drive module, respectively, the first output end thereof is connected with the control end of the drive module, and the second output end thereof is connected with the output end of the drive module and the input end of the light-emitting control module, respectively;

a control end of the light-emitting control module is connected with a light-emitting signal end, an output end thereof is connected with an input end of the light emitting device; and an output end of the light emitting device is connected with a low level signal end;

in the reset and compensation phase, the charge control module makes the data signal end and the first input end of the reset control module switch on under the control of the scan signal end; the reset control module resets the control end and the output end of the drive module and compensates reference voltage under the control of the threshold voltage signal end and the reference signal end. In the data writing phase, the charge control module writes the data signal inputted by the data signal end to the first input end of reset control module under the control of the scan signal end. In the light-emitting phase, the light-emitting control module makes the output end of the drive module and the input end of the light emitting device switch on to drive the light emitting device to emit light under the control of the light-emitting signal end.

The embodiment of the present disclosure provides an organic electroluminescent display panel, which comprises the pixel circuit provided by the embodiment of the present disclosure.

The embodiment of the present disclosure provides a display device, which comprises the organic electroluminescent display panel provided by the embodiment of the present disclosure.

The advantageous effects of the embodiment of the present disclosure comprise:

The embodiment of the present disclosure provides a pixel circuit, an organic electroluminescent display panel and a display device; in the reset and compensation phase, the charge control module in the pixel circuit makes the data signal end and the first input end of the reset control module switch on under the control of the scan signal end; the reset control module resets the control end and the output end of the drive module and compensates the reference voltage of the control end and the output end of the drive module under the control of the threshold voltage signal end and the reference signal end. In the data writing phase, the charge control module writes the data signal inputted by the data signal end to the first input end of the reset control module under the control of the scan signal end. In the light-emitting phase, the light-emitting control module makes the output end of the drive module and the input end of the light emitting device switch on under the control of the light-emitting signal end, and the light emitting device is driven to emit light by integrating the data signal inputted into the drive module with the reference voltage signal compensated to the drive module. Therefore, these realize the effect that the drive current driving the light emitting device to emit light is irrelevant to the power supply voltage signal inputted into the pixel circuits, eliminate the influence on luminous brightness of the light emitting device caused by IR drop of the power supply voltage signal inputted into the pixel circuits, and further guaranteeing the display effect of the display panel.

DETAILED DESCRIPTION OF THE EMBODIMENTS

Specific description of the pixel circuit, the organic electroluminescent display panel and the display device provided by the embodiment of the present disclosure are explained in more detail in relation to the drawings presented below.

Figure 1:
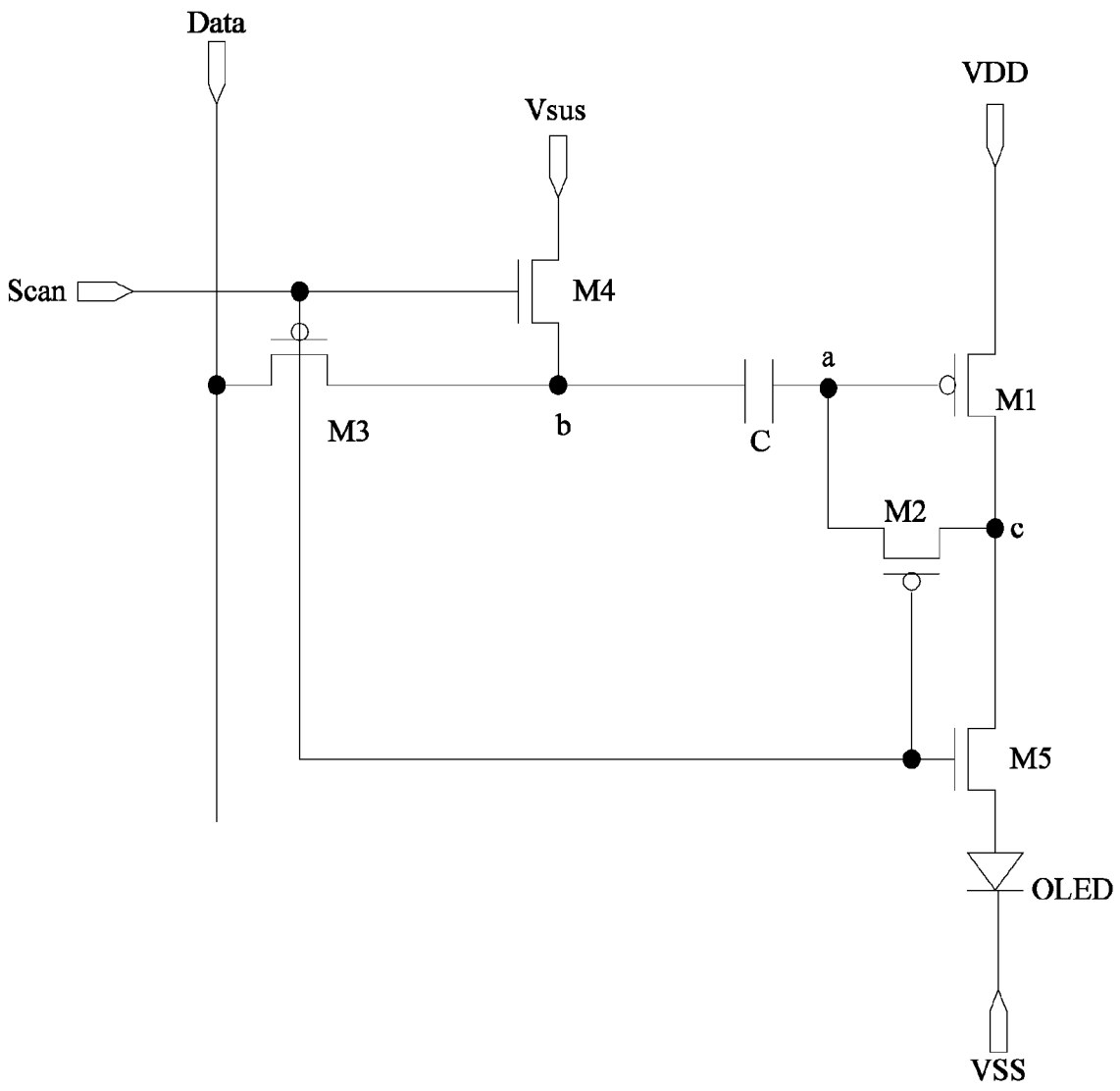
FIG. 1 is a schematic diagram of the structure of a well-known pixel circuit.

According to a circuit structure of AMOLED pixel circuit well-known by the inventor, the circuit structure as shown in FIG. 1 includes a first switching transistor M1, a second switching transistor M2, a third switching transistor M3, a fourth switching transistor M4, a fifth switching transistor M5, a storage capacitor C and a light emitting device OLED; wherein the gate of the first switching transistor M1 is connected with the source of the second switching transistor M2 and one end of the storage capacitor C, respectively, the source thereof is connected with the first reference signal end VDD, and the drain thereof is connected with the drain of the second switching transistor M2 and the source of the fifth switching transistor M5; the gate of the second switching transistor M2 is connected with the scan signal end Scan; the gate of the third switching transistor M3 is connected with the scan signal end Scan, the source of M3 is connected with the data signal end Data, and the drain of M3 is connected with the drain of the fourth switching transistor M4 and the other end of the storage capacitor C; the gate of the fourth switching transistor M4 is connected with the scan signal end Scan, and the source of M4 is connected with the second reference signal end Vsus; the gate of the fifth switching transistor M5 is connected with the scan signal end Scan and the drain of M5 is connected with one end of the OLED; and the other end of the light emitting device OLED is connected with the third reference signal end VSS.

Figure 2:
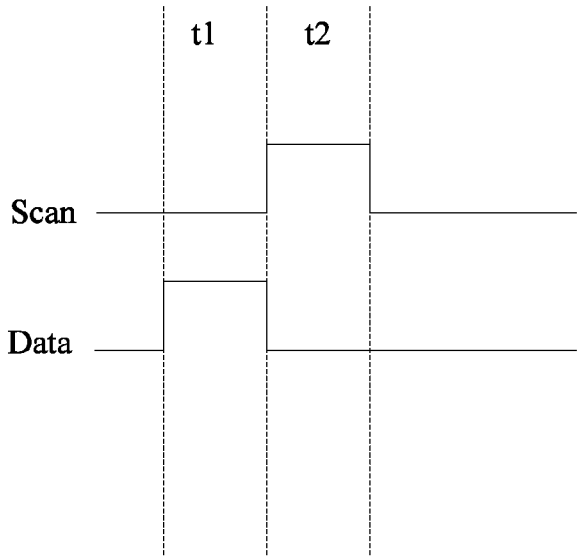
FIG. 2 is a specific operation timing chart of the pixel circuit shown in FIG. 1.

FIG. 2 is an operation timing chart of the pixel circuit shown in FIG. 1. In FIG. 2, it can be known that: stage t1, the scan signal input end Scan inputs low level signal, thus the second switching transistor M2 and the third switching transistor M3 are turned on and the fourth switching transistor M4 and the fourth switching transistor M5 are turned off; through the third switching transistor M3 that is turned on, the signal from data signal end Data is written to the left end of the storage capacitor C, that is, the voltage of point b is Vb=Vdata; the voltage of the right end of the storage capacitor, that is, the voltage of point a is Va=VDD−Vth; wherein Vth is the threshold voltage of the first switching transistor M1. At the same time, because the second switching transistor M2 is turned on, the voltage of point c equals that of point a, that is, Vc=Va=VDD−Vth; and the voltage difference between two ends of the storage capacitor C is Vb−Va=Vdata−VDD+Vth. In stage 2, the scan signal input end Scan inputs high level signal, thus the fourth switching transistor M4 and the fifth switching transistor M5 are turned on and the second switching transistor M2 and the third switching transistor M3 are turned off; the fourth switching transistor M4 that is turned on makes the second reference signal end Vsus and the left end of the storage capacitor C switch on, that is, point b; thus the voltage of point b is changed to Vsus and the voltage of point a, Va=Vsus−Vdata+VDD−Vth. Since the second switching transistor M2 is in a turning-off state, the voltage of point c is maintained in VDD−Vth. At the same time, the fifth switching transistor M5 that is turned on makes the drain of the first switching transistor M1 and one end of the light emitting device OLED switch on, which enables the drain of the first switching transistor M1 to output the drive current to the light emitting device OLED to drive the OLED to emit light. Based on the above analysis, it can be known that stage t1 is the data signal writing phase and stage t2 is the light emitting phase. In stage t2, the drive current that is outputted by switching transistor M1 to drive the OLED to emit light is:

$$I_{OLED} = \frac{\beta}{2}(Vgs - Vth)^2 = \frac{\beta}{2}(Va - Vc - Vth)^2 = \frac{\beta}{2}(Vsus - Vdata - Vth)^2$$

Wherein, Vgs is the voltage difference between the gate and the source of the first switching transistor M1, and β is the parameter relating to technological parameters and geometrical size of the first switching transistor M1. From the above derivation formula, it can be seen that the drive current driving the light emitting device OLED to emit light is relevant to the voltage signal inputted by the second reference signal end Vsus. In the detailed embodiment, the voltage signal inputted by the second reference signal end Vsus may be the voltage signal of the first reference signal end VDD, that is, the power supply voltage signal. However, when the power network that provides power supply voltage signal for the pixel circuits transmits power supply voltage signal from the signal source to its connected pixel circuits respectively through the power signal line, voltage drop (IR drop) occurs. The IR drop could influence the luminous brightness of the light emitting device OLED, and then impact the display effect of the display panel.

Figure 3:
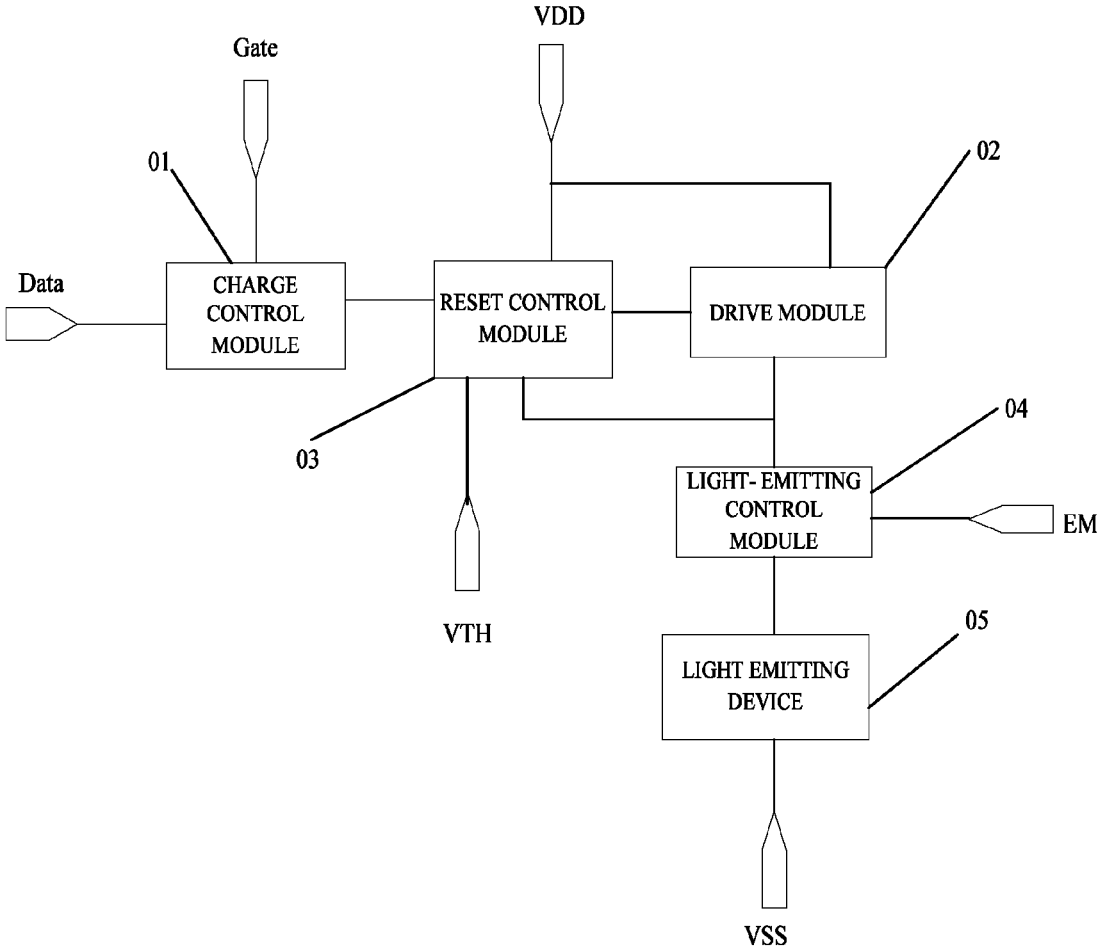
FIG. 3 is a schematic diagram of the pixel circuit provided by the embodiment of the present disclosure.

As shown in FIG. 3, the embodiment of the present disclosure provides a pixel circuit, which comprises: a charge control module 01, a drive module 02, a reset control module 03, a light-emitting control module 04 and a light emitting device 05; wherein the control end of the charge control module 01 is connected with the scan signal end Gate, the input end thereof is connected with the data signal end Data and the output end thereof is connected with the first input end of the reset control module 03;

the control end of the reset control module 03 is connected with the threshold voltage signal end VTH, the second input end thereof is connected with the reference signal end VDD and the input end of the drive module 02, respectively, the first output end thereof is connected with the control end of the drive module 02, and the second output end thereof is connected with the output end of the drive module 02 and the input end of the light-emitting control module 04, respectively;

the control end of the light-emitting control module 04 is connected with the light-emitting signal end EM, the output thereof is connected with the input end of the light emitting device 05, and the output end of the light emitting device 05 is connected with the low level signal end VSS;

in the reset and compensation phase, the charge control module 01 makes the data signal end Data and the first input end of the reset control module 03 switch on under the control of the scan signal end Gate, and the reset control module 03 resets the control end and the output end of the drive module 02 and compensates the reference voltage under the control of the threshold voltage signal end VTH and the reference signal end VDD; in the data writing phase, the charge control module 01 writes the data signal inputted by the data signal end Data to the first input end of reset control module 03 under the control of the scan signal end Gate; in the light-emitting phase, the light-emitting control module 04 makes the output end of the drive module 02 and the input end of the light emitting device 05 switch on under the control of the light-emitting signal end EM to drive the light emitting device 05 to emit light.

In the pixel circuit provided by the embodiment of the invention, in the reset and compensation phase, the charge control module 01 makes the data signal end Data and the first input end of the reset control module 03 switch on under the control of the scan signal end Gate, data signal inputted by the data signal end Data is inputted into the first input end of the reset control module 03, the reset control module 03 resets the control end and the output end of the drive module 02 and compensates the reference voltage under the control of the threshold voltage signal end VTH and the reference signal end VDD; that is, in the reset phase, low level Low is inputted into the reference signal end VDD, and the reset control module 03 resets the control end and the output end of the drive module 02; and in the compensation phase, high level ELVDD is inputted into the reference signal end VDD and the reset control module 03 charges the control end and the output end of the drive module 02 to implement the compensation; in the data writing phase, the charge control module 01 writes the data signal inputted by the data signal end Data to the first input end of the reset control module 03 under the control of the scan signal end Gate and then the reset control module 03 writes data signal to the control end of the drive module 02; in the light-emitting phase, the light-emitting control module 04 makes the output end of the drive module 02 and the input end of the light emitting device 05 switch on under the control of the light-emitting signal end EM, the light emitting device 05 is driven to emit light after eliminating the power supply voltage signal by integrating the data signal written to the drive module 02 with the reference voltage signal compensated to the drive module 02. Therefore, these realizes the effect that the drive current driving the light emitting device to emit light is irrelevant to the power supply voltage signal, eliminate the influence on luminous brightness of the light emitting device caused by IR drop of the power supply voltage signal inputted into the pixel circuits, and further guaranteeing the display effect of the display panel.

Figure 4:
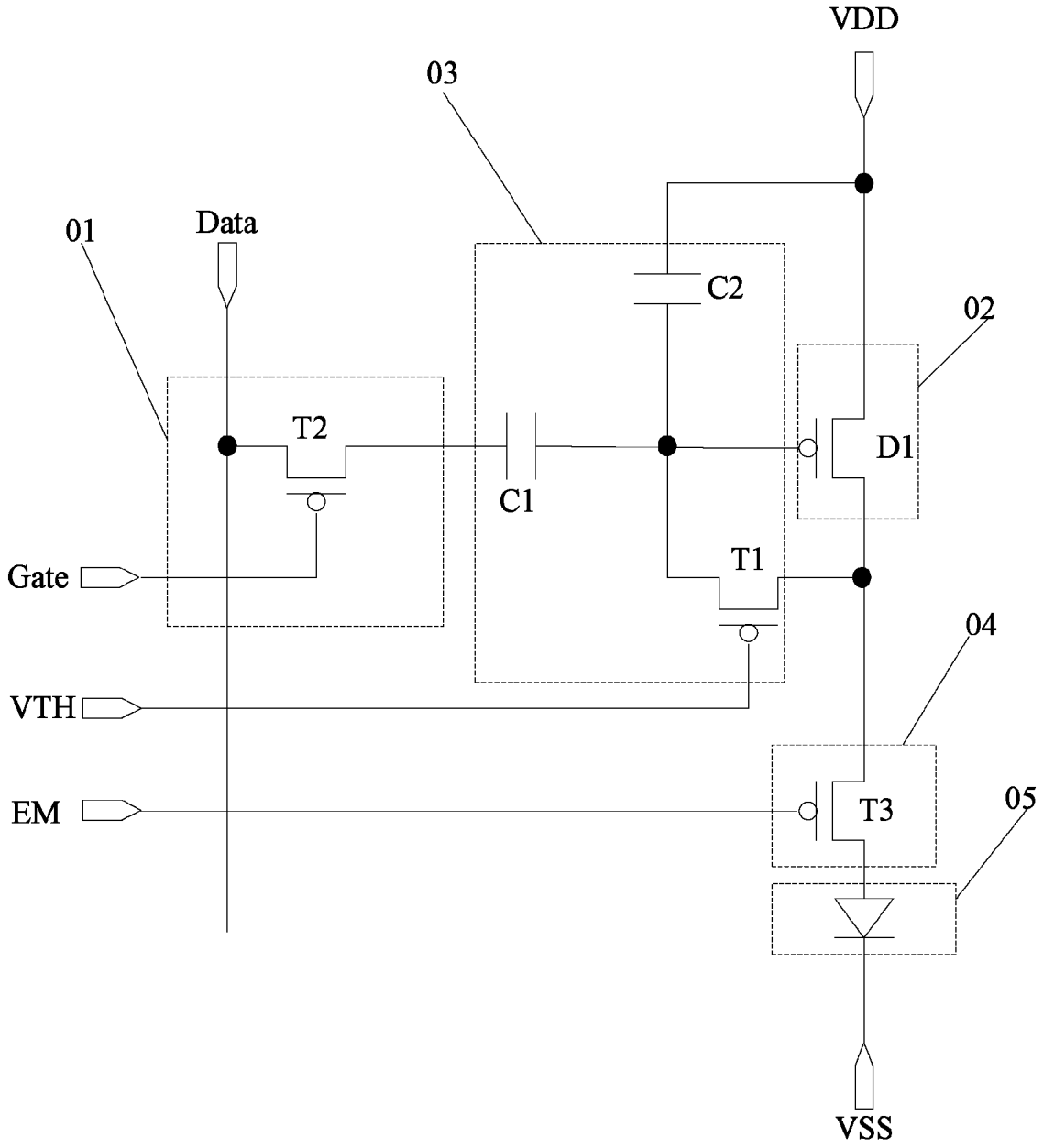
FIG. 4 is a schematic diagram of the specific structure of the pixel circuit provided by the embodiment of the present disclosure.

When the invention is carried out in detail, in the pixel circuit provided by the the embodiment of the present disclosure, the reset control module 03 as shown in FIG. 4 may comprises: the first capacitor C1, the second capacitor C2, and the first switching transistor T1; wherein the gate of the first switching transistor T1 is connected with the threshold voltage signal end VTH, the source thereof is connected with the control end of the drive module 02, and the drain thereof is connected with the output end of the drive module 02 and the input end of the light-emitting control module 04, respectively; the first capacitor C1 is connected between the output end of the charge control module 01 and the control end of the drive module 02; the second capacitor C2 is connected between the reference signal end VDD and the control end of the drive module 02. In the reset phase, the first switching transistor T1 is turned on under the control of the threshold voltage signal end VTH, the first switching transistor T1 that is turned on makes the control end and the output end of the drive module 02 switch on, low level Low is inputted into the reference signal end, and the process of resetting the control end and the output end of the drive module 02 are performed; in the compensation phase, high level ELVDD is inputted into the reference signal end VDD, the first switching transistor T1 is still in a turning-on state, the first switching transistor T1 that is turned on makes the control end and the output end of the drive module 02 switch on, and the reference voltage of the control end and input end of the drive module 02 is compensated.

When the invention is carried out in detail, in the pixel circuit provided by the the embodiment of the present disclosure, the first switching transistor T1 as shown in FIG. 4 is a P-type transistor; when low level signal is inputted into the threshold voltage signal end VTH, the first switching transistor T1 is in a turning-on state, the first switching transistor T1 that is turned on makes the control end and the output end of the drive module 02 switch on.

When the invention is carried out in detail, in the pixel circuit provided by the embodiment of the present disclosure, the charge control module 01 as shown in FIG. 4 may comprises: the second switching transistor T2, the gate of the second switching transistor T2 is connected with the scan signal end Gate, the source thereof is connected with the data signal end Data, and the drain thereof is connected with the first input end of the reset control module 03. In the reset and compensation phase, the second switching transistor T2 is turned on under the control of the scan signal end Gate, the second switching transistor T2 that is turned on makes the data signal end Data and the first input end of the reset control module 03 switch on and then writes the data signal inputted by the data signal end Data to the first input end of the reset control module 03; in the data writing phase, the second switching transistor T2 is still in the turning-on state, the second switching transistor T2 that is turned on writes the reference voltage signal Vref inputted by the data signal end Data to the first input end of the reset control module 03.

When the invention is carried out in detail, in the pixel circuit provided by the embodiment of the present disclosure, the second switching transistor T2 as shown in FIG. 4 is a P-type transistor; when low level signal is inputted into the scan signal end Gate, the second switching transistor T2 is in a turning-on state, the second switching transistor T2 that is turned on makes the data signal end Data and the first input end of the reset control module 03 switch on.

When the invention is carried out in detail, in the pixel circuit provided by the embodiment of the present disclosure, the drive module 02 as shown in FIG. 4 may comprises: the drive transistor D1; the gate of the drive transistor D1 is connected with the first output end of the reset control module 03, the source thereof is connected with the reference signal end VDD, the drain thereof is connected with the second output end of the reset control module 03 and the input end of the light-emitting control module 04, respectively; and the drive transistor D1 is a P-type transistor. In the reset phase, low level signal Low is inputted in the reference signal end which resets the gate of the drive transistor D1 to ensure that the drive transistor D1 is in the turning-on state in the compensation phase to implement the compensation process.

When the invention is carried out in detail, in the pixel circuit provided by the embodiment of the present disclosure, the light-emitting control module 04 as shown in FIG. 4 may comprises: the third switching transistor T3; the gate of the third switching transistor T3 is connected with the light-emitting signal end EM, the source thereof is connected with the output end of the drive module 02 and the second output end of the reset control module 03, respectively, and the drain thereof is connected with the input end of the light emitting device 05. In the light-emitting phase, the third switching transistor T3 is turned on under the control of the light-emitting signal end EM, the third switching transistor T3 that is turned on makes the output end of the drive module 02 and the input end of the light emitting device 05 switch on, which enables the drive module 02 to drive the light emitting device 05 to realize the normal luminescence function in the light-emitting phase.

When the invention is carried out in detail, in the pixel circuit provided by the embodiment of the present disclosure, the third switching transistor T3 as shown in FIG. 4 is a P-type transistor; when low level signal is inputted in the light-emitting signal end EM, the third switching transistor T3 is in a turning-on state, the third switching transistor T3 that is turned on makes the output end of the drive module 02 and the input end of the light emitting device 05 switch on.

It shall be noted that the switching transistor and the drive transistor mentioned in the above the embodiment of the present disclosure might be Thin Film Transistor (TFT) but also be Metal Oxide Semiconductor (MOS), and there is no limitation thereto. In the specific embodiment, the source and the drain of these transistors can be interchanged without particular distinction.

Figure 5:
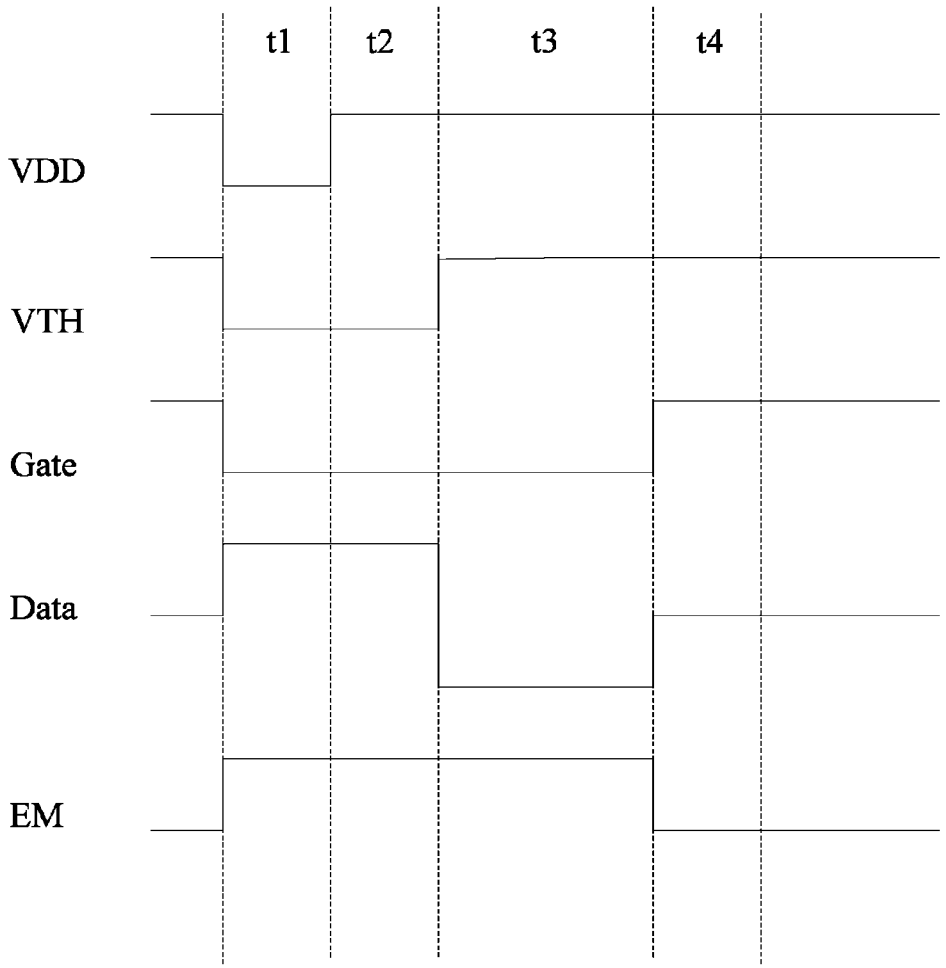
FIG. 5 is a specific operation timing chart of the pixel circuit shown in FIG. 4.

The operation process of the pixel circuit provided by the embodiments of the present invention is described in detail in relation to the pixel circuit and the timing of operation provided by the embodiment of the present disclosure below. According to the pixel circuit shown in FIG. 4 and the input and output timing chart of FIG. 4 shown in FIG. 5, the operation process of the pixel circuit provided by the embodiments of the present invention is described. Particularly, four stages t1-t4 in the input and output timing chart shown in FIG. 5 are selected. In the description below, 1 expresses high level signal and 0 expresses low level signal.

In t1 stage, VDD=low, VTH=0, Gate=0, Data=DATA, and EM=1. Due to VTH=0 and Gate=0, the first switching transistor T1 and the second switching transistor T2 are turned on; due to EM=1, the third switching transistor T3 is turned off. The first switching transistor T1 that is turned on makes the gate and the drain of the drive transistor D1 switch on, and the second switching transistor T2 that is turned on makes the data signal end Data and one end of the first capacitor C1 switch on; at this time, low level signal Low is inputted in the reference signal end VDD, thus the voltage of the gate and the drain of the drive transistor D1 are both low−Vth, wherein Vth is the threshold voltage of the drive transistor D1, the voltage difference between two ends of the first capacitor C1 is DATA−LOW+Vth, and the voltage difference between two ends of the second capacitor C2 is Vth, t1 stage is the reset phase.

In t2 stage, VDD=ELVDDE, VTH=0, Gate=0, Data=DATA, and EM=1. Due to VTH=0 and Gate=0, the first switching transistor T1 and the second switching transistor T2 are turned on; due to EM=1, the third switching transistor T3 is turned off. The first switching transistor T1 that is turned on makes the gate and the drain of the drive transistor D1 switch on, and the second switching transistor T2 that is turned on makes the data signal end Data and one end of the first capacitor C1 switch on; at this time, high level signal ELVDD is inputted into the reference signal end VDD, thus the gate of the drive transistor D1 is charged through the drive transistor D1 and the first switching transistor T1; when the gate of the drive transistor D1 is charged to ELVDD−Vth, the charge to the drive transistor D1 stops and concludes. The voltage of the drain of the drive transistor D1 is also ELVDD−Vth, then the voltage difference between two ends of the first capacitor C1 is DATA−ELVDD+Vth and the voltage difference between two ends of the second capacitor C2 is Vth. Stage t2 is the phase of compensation.

In t3 stage, VDD=ELVDD, VTH=1, Gate=0, Data=Vref, and EM=1. Due to Gate=0, the second switching transistor T2 is turned on; due to VTH=1 and EM=1, the first switching transistor T1 and the third switching transistor T3 are turned off. The second switching transistor T2 that is turned on makes the data signal end Data and one end of the first capacitor C1 switch on; at this time, the reference signal end VDD inputs high level signal ELVDD and data signal inputted by the data signal end Data is Vref, thus the voltage of the gate of the drive transistor D1 is ELVDD−Vth−DATA+Vref while the voltage of the drive transistor D1 is maintained in the voltage ELVDD−Vth at the former phase. Stage t3 is the data writing phase.

In t4 stage, VDD=ELVDD, VTH=1, Gate=1, Data=0, and EM=0. Due to EM=0, the third switching transistor T3 is turned on; due to VTH=1 and Gate=1, the first switching transistor T1 and the second switching transistor T2 are turned off. The third switching transistor T3 that is turned on makes the drain of the drive transistor D1 and the input end of the light emitting device 05 switch on, which enables the drive transistor D1 to drive the light emitting device 05 to implement normal luminescence function. Stage t4 is the light-emitting phase.

In t4 stage, the voltage of the gate of the drive transistor D1 is ELVDD−Vth−DATA+Vref, the voltage of the drain thereof is ELVDD−Vth, and the drive current driving the light emitting device 05 to emit light is $I=K(Vgs-Vth)^2=K(Vref-DATA-Vth)^2$; wherein K is the parameter in relation to technological parameters and geometrical size of the drive transistor D1, and Vgs is the voltage difference between the gate and the source of the drive transistor D1. From the above analysis, it can be known that the on-state current of the light emitting device 05 is indeed irrelevant to the power supply signal of the reference voltage end VDD so that the influence on luminous brightness of the light emitting device 05 caused by the IR drop of the power supply voltage signal inputted into the pixel circuits is eliminated.

Based on the same inventive concept, the embodiment of the present disclosure provides an organic electroluminescent display panel, which comprises the above pixel circuits provided by the embodiment of the present disclosure. Since the theory of using the organic electroluminescent display panel to solve the problem is similar to that of the pixel circuit, for the implementation of the organic electroluminescent display panel, see the implementation of the pixel circuit. The repetitious details need not be given here.

Figure 6:
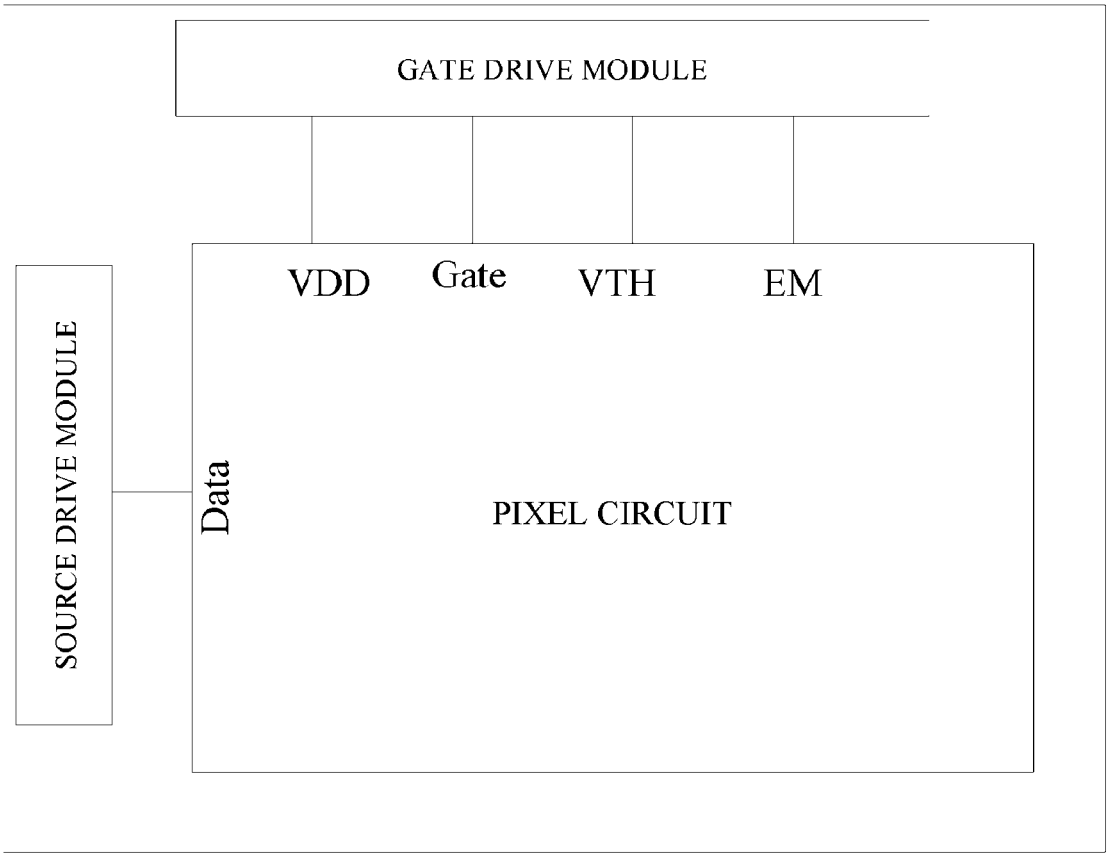
FIG. 6 is a schematic diagram of the structure of an organic electroluminescent display panel provided by the embodiment of the present disclosure.

When the invention is carried out in detail, in the organic electroluminescent display panel provided by the embodiment of the present disclosure, as shown in FIG. 6, a gate drive module may provide the corresponding control signal for the reference signal end VDD, scan signal end Gate, threshold voltage signal end VTH and light-emitting signal end EM in the pixel circuit, respectively and a source drive module provides data signal DATA and Vref for the data signal end Data at different stages.

Based on the same inventive concept, the embodiment of the present disclosure provides a display device which can be applied to mobile phones, tablet PCs, televisions, monitors, notebook computers, digital photo frame, navigation or any products or components with display function. Since the theory of using the display device to solve the problem is similar to that of the organic electroluminescent display panel, for the implementation of the display device, see the implementation of the organic electroluminescent display panel. The repetitious details need not be given here.

The embodiment of the present disclosure provides a pixel circuit, an organic electroluminescent display panel and a display device; in the reset and compensation phase, the charge control module in the pixel circuit makes the data signal end and the first input end of the reset control module switch on under the control of the scan signal end, and the reset control module resets the control end and the output end of the drive module and compensates the reference voltage under the control of the threshold voltage signal end and the reference signal end; in the data writing phase, the charge control module writes the data signal inputted by the data signal end to the first input end of the reset control module under the control of the scan signal end; in the light-emitting phase, the light-emitting control module makes the output end of the drive module and the input end of the light emitting device switch on under the control of the light-emitting signal end, and finally drives the light emitting device to emit light by integrating the data signal inputted into the drive module with the reference voltage signal compensated into the drive module. Then, these realize the effect that the drive current driving the light emitting device to emit light is irrelevant to the power supply voltage signal, eliminate the influence on luminous brightness of the light emitting device caused by IR drop of the power supply voltage signal inputted into the pixel circuits, and further guaranteeing the display effect of the display panel.

Obviously, those skilled in the art may make any possible changes and modifications without departing from the spirit and essence of the invention. And such changes and modifications are also considered as being within the scope of the invention if they belong to the scope of the claims and equal technology of the invention.

The present application claims priority to Chinese Patent Application No. 201410818108.1 filed on Dec. 24, 2014, the contents of which are hereby incorporated by reference in its entirety as part of the disclosure of the present application.

The invention claimed is:

1. A pixel circuit, comprising: a charge control module, a drive module, a reset control module, a light-emitting control module and a light emitting device; wherein a control end of the charge control module is connected with a scan signal end, an input end thereof is connected with a data signal end, and an output end thereof is connected with a first input end of the reset control module;

a control end of the reset control module is connected with a threshold voltage signal end, a second input end is connected with a reference signal end and an input end of the drive module, respectively, a first output end is connected with a control end of the drive module, and a second output end is connected with an output end of the drive module and an input end of the light-emitting control module, respectively;

a control end of the light-emitting control module is connected with a light-emitting signal end, an output end thereof is connected with an input end of the light emitting device; and an output end of the light emitting device is connected with a low level signal end;

in a reset and compensation phase, active level signal is inputted into the scan signal end, active level signal is inputted into the threshold voltage signal end, and non-active level signal is inputted into the light-emitting signal end, the charge control module makes the data signal end and the first input end of the reset control module switch on under the control of the scan signal end; the reset control module resets the control end and the output end of the drive module and compensates reference voltage under the control of the threshold voltage signal end and the reference signal end; in a data writing phase, active level signal is inputted into the scan signal end, non-active level signal is inputted into the threshold voltage signal end, and non-active level signal is inputted into the light-emitting signal end, the charge control module writes the data signal inputted by the data signal end to the first input end of the reset control module under the control of the scan signal end; in a light-emitting phase, non-active level signal is inputted into the scan signal end, non-active level signal is inputted into the threshold voltage signal end, and active level signal is inputted into the light-emitting signal end, the light-emitting control module makes the output end of the drive module and the input end of the light emitting device switch on to drive the light emitting device to emit light under the control of the light-emitting signal end.

2. The pixel circuit according to claim 1, the reset control module comprises: a first capacitor, a second capacitor, and a first switching transistor; wherein a gate of the first switching transistor is connected with a threshold voltage signal end, a source thereof is connected with a control end of the drive module, and a drain thereof is connected with an output end of the drive module and an input end of the light-emitting control module, respectively;

the first capacitor is connected between an output end of the charge control module and a control end of the drive module; and the second capacitor is connected between the reference signal end and the control end of the drive module.

3. The pixel circuit according to claim 2, wherein, in the reset phase, the first switching transistor is turned on under the control of the threshold voltage signal end, the first switching transistor that is turned on makes the control end and the output end of the drive module switch on, low level is inputted into the reference signal end, and the process of resetting the control end and the output end of the drive module is performed;

in the compensation phase, high level is inputted into the reference signal end, and the first switching transistor is still in a turning-on state, the first switching transistor that is turned on makes the control end and the output end of the drive module switch on, and the reference voltage of the control end and the input end of the drive module is compensated.

4. The pixel circuit according to claim 3, wherein the first switching transistor is a P-type transistor.

5. The pixel circuit according to claim 1, the charge control module comprises: a second switching transistor;

a gate of the second switching transistor is connected with the scan signal end, a source thereof is connected with the data signal end, and a drain thereof is connected with the first input end of the reset control module.

6. The pixel circuit according to claim 5, wherein, in the reset and compensation phase, the second switching transistor is turned on under the control of the scan signal end, the second switching transistor that is turned on makes the data signal end and the first input end of the reset control module switch on and then writes the data signal inputted by the data signal end to the first input end of the reset control module;

in the data writing phase, the second switching transistor is still in the turning-on state, the second switching transistor that is turned on writes the reference voltage signal inputted by the data signal end to the first input end of the reset control module.

7. The pixel circuit according to claim 6, wherein the second switching transistor is a P-type transistor.

8. The pixel circuit according to claim 1, the drive module comprises: a drive transistor;

a gate of the drive transistor is connected with the first output end of the reset control module, a source thereof is connected with the reference signal end, and a drain thereof is connected with the second output end of the reset control module and the input end of the light-emitting control module.

9. The pixel circuit according to claim 8, wherein, in the reset phase, low level signal is inputted in the reference signal end which resets the gate of the drive transistor to ensure that the drive transistor is in the turning-on state in the compensation phase to implement the compensation process.

10. The pixel circuit according to claim 9, wherein the drive transistor is a P-type transistor.

11. The pixel circuit according to claim 1, the light-emitting control module comprises: a third switching transistor;

a gate of the third switching transistor is connected with the light-emitting signal end, a source thereof is connected with the output end of the drive module and the second output end of the reset control module, and a drain thereof is connected with the input end of the light emitting device.

12. The pixel circuit according to claim 11, wherein, in the light-emitting phase, the third switching transistor is turned on under the control of the light-emitting signal end, the third switching transistor that is turned on makes the output end of the drive module and the input end of the light emitting device switch on, which enables the drive module to drive the light emitting device to realize the normal luminescence function in the light-emitting phase.

13. The pixel circuit according to claim 12, wherein the third switching transistor is a P-type transistor.

14. An organic electroluminescent display panel, comprising a pixel circuit, the pixel circuit comprises: a charge control module, a drive module, a reset control module, a light-emitting control module and a light emitting device; wherein a control end of the charge control module is connected with a scan signal end, an input end thereof is connected with a data signal end, and an output end thereof is connected with a first input end of the reset control module;

a control end of the reset control module is connected with a threshold voltage signal end, a second input end is connected with a reference signal end and an input end of the drive module, respectively, a first output end is connected with a control end of the drive module, and a second output end is connected with an output end of the drive module and an input end of the light-emitting control module, respectively;

a control end of the light-emitting control module is connected with a light-emitting signal end, an output end thereof is connected with an input end of the light emitting device; and an output end of the light emitting device is connected with a low level signal end;

in a reset and compensation phase, active level signal is inputted into the scan signal end, active level signal is inputted into the threshold voltage signal end, and non-active level signal is inputted into the light-emitting signal end, the charge control module makes the data signal end and the first input end of the reset control module switch on under the control of the scan signal end; the reset control module resets the control end and the output end of the drive module and compensates reference voltage under the control of the threshold voltage signal end and the reference signal end; in a data writing phase, active level signal is inputted into the scan signal end, non-active level signal is inputted into the threshold voltage signal end, and non-active level signal is inputted into the light-emitting signal end, the charge control module writes the data signal inputted by the data signal end to the first input end of the reset control module under the control of the scan signal end; in a light-emitting phase, non-active level signal is inputted into the scan signal end, non-active level signal is inputted into the threshold voltage signal end, and active level signal is inputted into the light-emitting signal end, the light-emitting control module makes the output end of the drive module and the input end of the light emitting device switch on to drive the light emitting device to emit light under the control of the light-emitting signal end.

15. The organic electroluminescent display panel according to claim 14, the reset control module comprises: a first capacitor, a second capacitor, and a first switching transistor; wherein a gate of the first switching transistor is connected with a threshold voltage signal end, a source thereof is connected with a control end of the drive module, and a drain thereof is connected with an output end of the drive module and an input end of the light-emitting control module, respectively;

the first capacitor is connected between an output end of the charge control module and a control end of the drive module;

and the second capacitor is connected between the reference signal end and the control end of the drive module.

16. The organic electroluminescent display panel according to claim 14, the charge control module comprises: a second switching transistor;

a gate of the second switching transistor is connected with the scan signal end, a source thereof is connected with the data signal end, and a drain thereof is connected with the first input end of the reset control module.

17. The organic electroluminescent display panel according to claim 14, the drive module comprises: a drive transistor;

a gate of the drive transistor is connected with the first output end of the reset control module, a source thereof is connected with the reference signal end, and a drain thereof is connected with the second output end of the reset control module and the input end of the light-emitting control module.

18. The organic electroluminescent display panel according to claim 14, the light-emitting control module comprises: a third switching transistor;

a gate of the third switching transistor is connected with the light-emitting signal end, a source thereof is connected with the output end of the drive module and the second output end of the reset control module, and a drain thereof is connected with the input end of the light emitting device.

19. A display device, comprising the organic electroluminescent display panel according to claim 14.

* * * * *